US005082466A

United States Patent [19]

Rubenstein et al.

[11] Patent Number: 5,082,466

[45] Date of Patent: Jan. 21, 1992

[54] ANTI-STATIC GARMENT BAG FOR REDUCING STATIC BUILDUP IN THE DRYCLEANING PROCESS

[75] Inventors: Gerald N. Rubenstein, Pittsburgh, Pa.; John H. Geer, Cincinnati, Ohio

[73] Assignee: Fabritec International Corporation, Cold Spring, Ky.

[21] Appl. No.: 468,211

[22] Filed: Jan. 22, 1990

Related U.S. Application Data

[62] Division of Ser. No. 241,403, Sep. 7, 1988, Pat. No. 4,989,995.

[51] Int. Cl.[5] ..... D06F 43/00

[52] U.S. Cl. ..... 8/142; 383/117; 8/137

[58] Field of Search ..... 8/142; 383/102, 117, 383/116

[56] References Cited

U.S. PATENT DOCUMENTS

| | | | |
|---|---|---|---|
| 940,430 | 11/1909 | Chapman | 361/230 |
| 1,394,211 | 10/1921 | Morgan | 361/221 |
| 1,508,400 | 9/1924 | Kronmiller | 68/209 |
| 1,701,156 | 2/1929 | Heritage | 219/10 |
| 1,747,324 | 2/1930 | Savitt | 8/142 |
| 1,814,378 | 7/1931 | Gilbertson et al. | 383/117 |
| 1,915,196 | 6/1933 | McGuire | 220/489 |
| 1,928,670 | 10/1933 | McCrery | 55/300 |
| 1,983,451 | 12/1934 | Gwaltney | 139/389 |
| 1,983,452 | 12/1934 | Gwaltney | 139/389 |
| 1,991,934 | 2/1935 | McCray | 250/436 |
| 2,100,951 | 11/1937 | Glass et al. | 210/461 |
| 2,103,758 | 12/1937 | Seyfried | 68/207 |
| 2,132,734 | 10/1938 | Hart et al. | 383/102 |
| 2,333,213 | 11/1943 | Slayter | 361/213 |
| 2,511,644 | 6/1950 | Liss | 383/117 |
| 2,544,223 | 3/1951 | Ellis | 139/389 |
| 2,555,561 | 6/1951 | Whitehead | 383/102 |
| 2,564,926 | 8/1951 | Rapier | 252/161 |
| 2,568,068 | 9/1951 | Harpman | 175/264 |
| 2,602,482 | 7/1952 | Lyon | 383/97 |
| 2,647,223 | 7/1953 | Check | 383/97 |
| 2,688,806 | 9/1954 | Long | 34/75 |
| 2,701,421 | 2/1955 | Erickson et al. | 34/45 |
| 2,729,576 | 1/1956 | Trusler | 8/142 |
| 2,804,898 | 9/1957 | Cox | 150/3 |
| 2,807,948 | 10/1957 | Bonney | 68/13 |
| 2,818,719 | 1/1958 | Cline | 68/19 |
| 2,818,900 | 1/1958 | Forman | 383/71 |
| 2,907,923 | 10/1959 | Short | 317/2 |
| 2,975,528 | 3/1961 | Shewmon | 34/133 |
| 3,151,345 | 10/1964 | Massop | 8/142 |
| 3,161,479 | 12/1964 | Biderman | 34/1 |
| 3,197,885 | 8/1965 | Smith | 34/45 |
| 3,266,166 | 8/1966 | Fuhring | 34/32 |
| 3,288,175 | 11/1966 | Valko | 139/425 |
| 3,320,479 | 5/1967 | Owens | 317/2 |
| 3,331,221 | 7/1967 | Lawson, Jr. | 66/170 |
| 3,359,567 | 12/1967 | Zemme et al. | 2/2 |
| 3,468,036 | 9/1969 | Blaettler | 34/22 |

(List continued on next page.)

FOREIGN PATENT DOCUMENTS

| | | | |
|---|---|---|---|
| 99369 | 6/1983 | Japan | 383/117 |

OTHER PUBLICATIONS

F. W. Billmeyer, Jr., "Textbook of Polymer Science", p. 432 Interscience (1963).

Ikemoto Epochal Cloth Brochure and Ad (referred to collectively as "Ikemoto Literature").

Textile Fibers, Dyes, Finishes, and Processes (A Concise Guide); Howard L. Needles, Noyes Publications, Park Ridge, NJ, 1986, pp. 144–145.

Beane Filter Media, Inc. brochure entitled, "Filter Media & Filter Products".

Monsanto Fibers & Intermediates Company brochure entitled "No-Shock Conductive Nylon Fiber by Monsanto".

*Primary Examiner*—Prince Willis, Jr.
*Assistant Examiner*—John F. McNally
*Attorney, Agent, or Firm*—Wood, Herron & Evans

[57] ABSTRACT

An anti-static net garment bag is described for eliminating static buildup in the drycleaning process, in addition to performing the protective function normally provided by a net garment bag during the drycleaning process.

15 Claims, 1 Drawing Sheet

U.S. PATENT DOCUMENTS

| | | | |
|---|---|---|---|
| 3,510,386 | 5/1970 | Goins et al. | 161/66 |
| 3,586,597 | 6/1971 | Okuhashi | 428/242 |
| 3,642,644 | 2/1972 | Grote et al. | 252/153 |
| 3,732,628 | 5/1973 | Blevens et al. | 34/32 |
| 3,761,071 | 9/1973 | Behn | 270/61 |
| 3,784,876 | 1/1974 | DeGaston | 317/2 |
| 3,827,931 | 8/1974 | Rothwell et al. | 161/27 |
| 3,838,983 | 10/1974 | Brown et al. | 29/191.6 |
| 3,870,145 | 3/1975 | Mizuno | 206/84 |
| 3,875,679 | 4/1975 | Condit | 34/75 |
| 3,875,681 | 4/1975 | DePas | 34/75 |
| 3,904,929 | 9/1975 | Kanaya et al. | 317/2 |
| 3,953,913 | 5/1976 | Brown et al. | 28/76 R |
| 3,972,128 | 8/1976 | Vanicek | 34/32 |
| 3,986,530 | 10/1976 | Maekawa | 139/425 R |
| 3,991,479 | 11/1976 | Dionne | 34/1 |
| 4,010,004 | 3/1977 | Brown et al. | 29/191.6 |
| 4,010,785 | 3/1977 | Patik | 150/7 |
| 4,057,071 | 11/1977 | Rhodes | 137/1 |
| 4,061,827 | 12/1977 | Gould | 428/368 |
| 4,098,937 | 7/1978 | Mizuno et al. | 428/68 |
| 4,145,818 | 3/1979 | Kulling | 34/10 |
| 4,148,147 | 4/1979 | Steffen | 34/27 |
| 4,154,003 | 5/1979 | Muller | 34/32 |
| 4,168,579 | 9/1979 | Ericsson | 34/46 |
| 4,170,678 | 10/1979 | Urfer et al. | 428/124 |
| 4,190,874 | 2/1980 | Pasold | 361/212 |
| 4,232,082 | 11/1980 | Noritake | 428/225 |
| 4,241,515 | 12/1980 | Wochnowski et al. | 34/28 |
| 4,284,507 | 8/1981 | Beane | 210/435 |
| 4,322,232 | 3/1982 | Beane | 55/360 |
| 4,329,788 | 5/1982 | Sterlini | 34/27 |
| 4,345,297 | 8/1982 | Check | 361/215 |
| 4,348,174 | 9/1982 | Spigarelli | 432/1 |
| 4,388,370 | 6/1983 | Ellis et al. | 428/368 |
| 4,388,739 | 6/1983 | Martinon et al. | 8/150 |
| 4,420,529 | 12/1983 | Westhead | 428/244 |
| 4,422,483 | 12/1983 | Zins | 139/420 |
| 4,426,791 | 1/1984 | Coppa | 34/27 |
| 4,431,316 | 2/1984 | Massey | 383/117 |
| 4,473,373 | 9/1984 | Weiss | 8/137 |
| 4,494,264 | 1/1985 | Wattiez et al. | 8/150 |
| 4,557,968 | 12/1985 | Thornton et al. | 428/229 |
| 4,618,909 | 10/1986 | Sanders | 361/212 |
| 4,630,312 | 12/1986 | Milstein | 383/86 |
| 4,631,630 | 12/1986 | Beane | 361/212 |
| 4,714,353 | 12/1987 | Leaphart | 383/117 |
| 4,754,364 | 6/1988 | Speet et al. | 361/212 |

ANTI-STATIC GARMENT BAG FOR REDUCING STATIC BUILDUP IN THE DRYCLEANING PROCESS

This is a division of application Ser. No. 07/241,403, field Sept. 7, 1988, U.S. Pat. No. 4,989,995.

BACKGROUND OF THE INVENTION

I. Field of the Invention

The present invention relates to a method of reducing static electricity buildup during the dry-cleaning process such as often occurs in the drying phase.

II. Description of the Prior Art

The problems created by static buildup are well known. For example, in the dry-cleaning industry, static buildup is known to have a deleterious effect on garments in that there is a tendency for lint to be attracted to the garment. Accumulation of lint on the garments during the dry-cleaning process is to be avoided else the already-cleaned garment will not be acceptable to the customer Static buildup is also known to cause "static cling", i.e., garments tend to cling to one another and may even cling to the dry-cleaning equipment. Separating the garments from one another and from the dry-cleaning equipment may be a painful experience to the dry-cleaning operator who may be shocked in the process Buildup of static electricity is most likely to occur during the tumbling of garments in a dry-cleaning unit or dryer reclaimer during the removal of solvent from dry-cleaned articles, i.e., during the drying phase. Such buildup of static is particularly noticeable when the relative humidity of the ambient environment is low.

Numerous approaches to reducing such static buildup have been proposed For example, it has been proposed to electrically ground the dry-cleaning equipment. While this is desirable from a safety standpoint, it has not been found to sufficiently reduce static buildup. Another approach has been to include a chemical treatment in the load to reduce static buildup. This approach requires the factory to maintain an inventory of the chemical product to resupply chemical as it is consumed and thus adds cost to the process. Further, some chemicals may adversely affect the dry-cleaning process and equipment. Another approach has been to introduce moisture into the drying phase of the dry-cleaning process. This approach suffers in that it may also adversely affect the dry-cleaning process and equipment.

One promising and relatively simple approach is the inclusion of an anti-static cloth in a load of garments to be dry-cleaned or tumble dried Such cloth is a rectangular patch of nonconductive threads tightly knitted or woven into a fabric. Included in the fabric are a number of conductive threads to render the cloth anti-static. The conductive threads are believed to contain carbon or graphite or the like and are further believed to be woven or knitted into the fabric to form a plurality of spaced-apart courses or bands (in the warp direction, for example) throughout the fabric. Inclusion of one or more such cloths in a load of garments during the dry-cleaning process substantially reduces static buildup under many conditions.

The use of an anti-static cloth brings with it certain drawbacks, however. For example, as with chemical anti-static treatment, the dry-cleaning establishment would have to maintain an inventory of anti-static cloths so that they are readily available for inclusion in each load. The cloths thus take up space in the dry-cleaning factory The cloths also represent an item which operators must consciously remember to include in the load; reliance on operators to perform an extra step to which they are not accustomed has obvious drawbacks An important and perhaps fundamental drawback with the use of an anti-static cloth is that such a cloth is not believed to be sufficient to effectively reduce static buildup under certain commonly encountered conditions.

In particular, it is common practice to encase certain garment articles in a net bag before inclusion in the dry-cleaning equipment as part of a larger load of garments. Such bags are widely used to avoid unnecessary rubbing action with delicate garments which might otherwise be damaged in the dry-cleaning process. For example, soft wool garments might typically be encased in such a bag during the dry-cleaning process to prevent distortion or "felting". After the dry-cleaning process is completed, the operator merely opens the bag and upends the bag to drop the clean garments out of the bag.

The net bags generally used in the dry-cleaning industry are made from synthetic fibers such as nylon or polyester. Synthetic fabrics encourage static buildup. Consequently, static buildup between the bag and the garments may be so substantial that in addition to static buildup problems already discussed, the operator cannot remove the garments except by "tearing" the garments away from the inner wall of the bag. Indeed, while use of an anti-static cloth in the load has been effective to reduce static buildup throughout most of the load, the static buildup within and about the bag is not believed to be effectively reduced or eliminated.

SUMMARY OF THE INVENTION

The present invention is believed to overcome the above deficiencies and drawbacks by making the net bag itself anti-static. Use of such a bag is believed to advantageously reduce static buildup throughout the entire load of garments while simultaneously protecting any garments encased in the bag. Thus, the present invention is believed to reduce static buildup throughout the entire dry-cleaning load and not just in the garments outside the net bag as could be accomplished with the anti-static cloth. While providing an overall reduction in static buildup, the present invention also obviates the need to use chemical or humidity treatments or a separate anti-static cloth and thus eliminates the drawbacks associated therewith. Net bags are part of the normal and necessary inventory for the dry-cleaner and are routinely employed Hence, using anti-static net bags does not increase the inventory or space requirements of the dry-cleaning facility nor is an operator necessarily required to undertake an unaccustomed or unusual step.

In accordance with the principles of the present invention, the bag is rendered anti-static by including several conductive threads or strands along with the non-conductive fibers or yarns from which the net bag is made. The conductive fibers are preferably to be knitted along with the non-conductive fibers to form a matrix pattern in the bag. The matrix provides a continuous electrical path between any two sites on the bag through which conductive strands pass. Further, the conductive strands are preferably silver plated nylon filaments rather than fibers impregnated with carbon or the like.

These and other objects and advantages of the invention shall be made apparent from the accompanying drawings and the description thereof

BRIEF DESCRIPTION OF THE DRAWINGS

The accompanying drawings, which are incorporated in and constitute a part of the specification, illustrate a preferred embodiment of the invention and, together with a general description of the invention given above, and the detailed description of the preferred embodiment given below, serve to explain the principles of the invention.

DETAILED DESCRIPTION OF THE DRAWINGS

Figure 1:
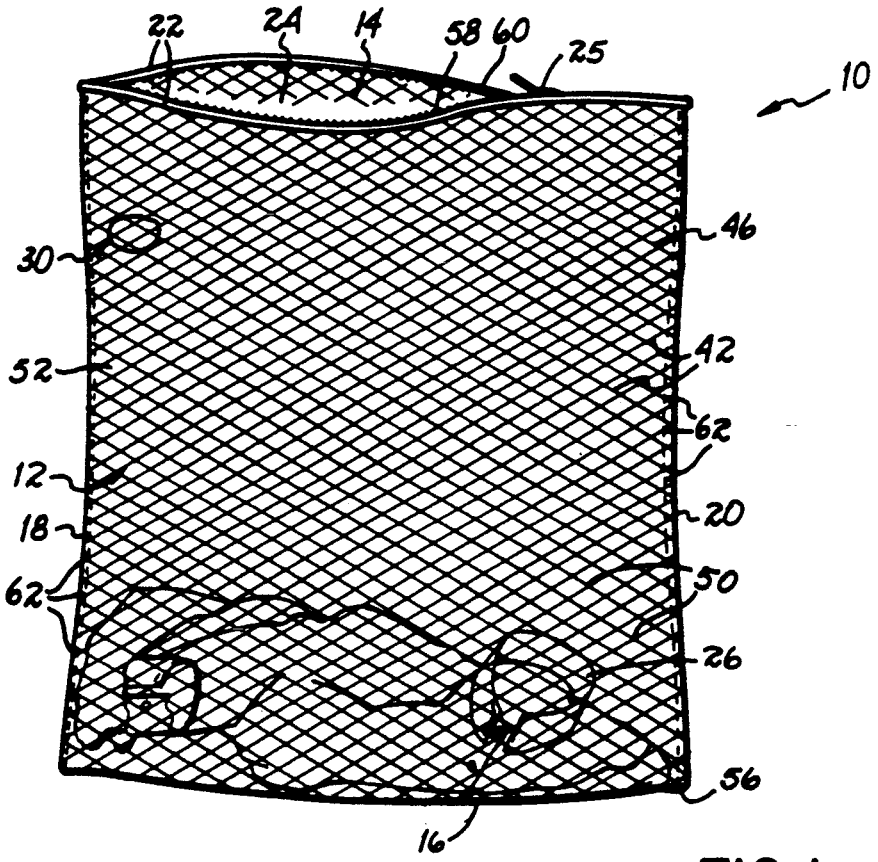
FIG. 1 shows schematically an anti-static net garment bag for purposes of explaining the principles of the present invention.

With reference to FIG. 1 there is shown schematically an anti-static bag 10 for use in reducing static buildup in the dry-cleaning process. Bag 10 has flexible mesh or net sidewalls 12, 14 joined together at the bottom 16 and along the sides 18, 20. Bag 10 is open at the top 22. An inner garment-receiving cavity 24 is defined between sidewalls 12, 14. A closure means such as a zipper 25 is joined to sidewalls 12, 14 about the periphery of top 22 thereof as is well known in order to close bag 10 to retain one or more garments 26 therein during the dry-cleaning process.

Sidewalls 12, 14 are formed by warp knitting yarns 28 (shown with stipling in FIG. 3) in a net or mesh pattern. Preferably two 90 denier polyester filament yarns 28 for a total denier of 180 are woven in each direction. As may be seen more clearly in the exploded view of a portion 30 of bag 10 depicted in FIG. 2, yarns 28 are warp knitted in a conventional fashion to form several columns 34 of small interstices 36 and several spaced-apart columns 38 of larger interstices 40. Interstices 36, 40 adapt bag 10 for dry-cleaning by providing pathways for dry-cleaning solvent and dirt to pass for well understood purposes, while maintaining the garment(s) 26 within the bag. To this end, interstices 36, 40 may be oval in shape with a maximum diameter of about 2 mm and 4 mm, respectively.

Yarns 28 are typically nonconductive For purposes of the present invention, it is necessary that sidewalls 12, 14 be rendered conductive so as to function to reduce static buildup. To this end, bag 10 is rendered conductive, i.e., anti-static, by the inclusion of conductive strands 42 (non-stipled fibers in FIG. 3) knitted in amongst yarns 28.

Figure 2:
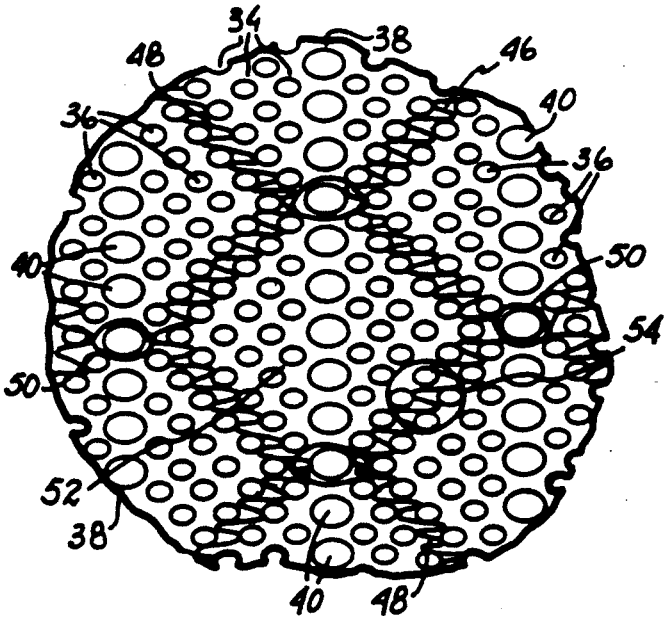
FIG. 2 is an enlarged, diagrammatic view of a portion of the bag of FIG. 1.
Figure 3:
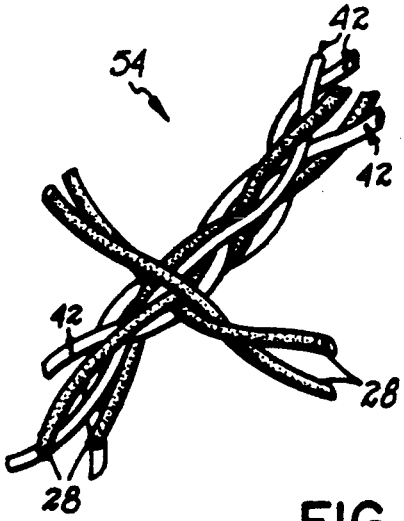
FIG. 3 is an enlarged view showing the yarn and conductive strands knitted to form a portion of the net bag.

Preferably three 7 denier monofilament nylon fibers 42 for a total denier of 21 are knitted into sidewalls 12, 14 along with two yarns 28 (FIG. 3). Each of the nylon fibers 42 is rendered electrically conductive by chemical plating with silver to 13% by weight of silver. Although strands 42 are preferably silver plated, they may alternatively be impregnated with a conductive material such as carbon. Strands 42 are provided in sidewalls 12, 14 in a diamond grid or matrix pattern 46 (represented by lines 48 in FIG. 2) which intersects larger interstices 40 such as at 50. An intersection 50 occurs at about every sixth interstice in each column 38 such that each of the diamonds 52 in grid pattern 46 is approximately 20 mm by 25 mm (between left and right corners, and top and bottom corners, respectively, as seen in FIG. 2). The result is a conductive matrix pattern 46 which provides a substantially continuous low electrical resistance over the entire inner and outer surfaces of sidewalls 12, 14. The electrical resistance is less than 1 kilohm and preferably less than 200 ohms between any two portions 30 of sidewalls 12, 14 within 12 inches of each other (as long as each portion includes a portion of fiber 44 therein). Thus, bag 10 is conductive essentially throughout so that static buildup between a garment 26 and bag 10 at any portion 30 may be discharged into the dry-cleaning solvent or equipment through any other portion 30 which contacts the solvent or equipment Bag 10 may be formed of a length of net material formed by knitting yarns 28 and strands 42 together as before described and as seen in FIG. 3 showing an enlarged view of a portion 54 of FIG. 2. The net material is then folded in half lengthwise along a fold line 56 such that the lateral edges 58, 60 of the length of fabric are in overlying relationship to form top 22. The overlapping or confronting, longitudinal edges are sewn or knitted together (as shown by dotted lines 62 in FIG. 1) forming sides 18 and 20 to define garment receiving cavity 24. Zipper 25 is sewn into edges 58, 60 to define a closable top over cavity 24. Bottom 16 of bag 10 is defined by fold line 56 and defines a closed bottom to cavity 24 Other constructions for bag 10 will be apparent to those of ordinary skill in the art and need not be detailed herein.

In use, one or more delicate garments 26 are loaded into cavity 24 of bag 10 through top 22 and zipper 25 closed to seal top 22 and secure garment(s) 26 within bag 10. Bag 10 is then placed in a dry-cleaning machine (not shown), typically along with further garments (not shown) some of which may also be in net bags such as those contemplated by the present invention The dry-cleaning process is then begun. The drum of the dry-cleaning machine used during the drying phase is preferably grounded After the drying phase is completed, the load of garments is removed from the machine, zipper 25 is opened to permit access to cavity 24 and garment(s) 26 removed therefrom such as by upending the bag and dropping out the clean garment(s). It is believed that during the drying phase of that process, conductive strands 42 provided in the sidewalls of bag 10 will sufficiently reduce static buildup such that upon completion of the dry-cleaning process, there will be no harmful static buildup on the garments or bag. The operator may thus remove the entire load of dry-cleaning from the machine, and garment(s) 26 from bag 10, without undesirable shock, static cling or lint accumulation.

Although the invention is not so limited, exemplary yarns 28 and strands 42 may be those provided in material available from Apex Mills Corp. of Lynbrook, NY. In particular, Apex Mills supplies its material P-39 which is a knitted net material comprised of yarns 28. Apex Mills also supplies its material NH-6 which includes conductive strands 42. Indeed, bag 10 may be formed from Apex Mills material NH-6 although it is not believed to be as sturdy as bag 10 described herein which is essentially Apex Mills material P-39 with conductive strands 42. While yarns 28 are preferably nonconductive synthetic yarns, they could be of other nonconductive material such as cotton or the like. Further, although bag 10 includes zipper 25 as a closure, other closure means are well known and may be employed.

By virtue of the foregoing, there is described an anti-static bag and the method of using same to reduce static buildup in the dry-cleaning process of garments Additional advantages and modifications will readily appear to those skilled in the art. For example, where no delicate garments are to be cleaned, bag 10 may be used in lieu of a separate anti-static cloth or chemical treatment to thereby eliminate the need to maintain a separate inventory of anti-static cloths or chemicals, for example. The present invention in its broader aspect is therefore not limited to the preferred embodiment and illustrated example shown and described. Accordingly, departures may be made from such details without departing from the spirit or scope of the present invention.

Having described the invention, what is claimed is:

1. A method for reducing static buildup on garments during a solvent based dry-cleaning process with a garment bag having a sidewall formed substantially of non-conductive yarns joined together to define a plurality of interstices sized to permit solvent and dirt from garments contained in the garment bag, but no the garments themselves to pass therethrough, the garment bag further having an opening sized to permit garments to pass therethrough and through which garments are receivable into the garment bag, the method comprising:

interspersing a plurality of conductive strands in the sidewall of the garment bag to render the sidewall conductive and the garment bag anti-static;

passing at least one of the garments through the opening and into the garment bag before performing the dry-cleaning process;

placing the garment bag in a dry-cleaning machine along with a load of garments to be dry-cleaned; and performing the dry-cleaning process.

2. The method of claim 1 further comprising:

after performing the dry-cleaning process, removing the load of garments from the dry-cleaning machine.

3. The method of claim 1 further comprising:

after performing the dry-cleaning process, removing the garment from the garment bag through the opening.

4. The method of claim 1 further comprising:

after performing the dry-cleaning process, removing the garment bag encasing the garment and the further garments from the dry-cleaning machine.

5. The method of claim 1 wherein interspersing conductive strands includes:

knitting the conductive strands into the sidewall along with the non-conductive yarns.

6. The method of claim 1 wherein the conductive strands are interspersed in a matrix pattern throughout the sidewall.

7. A method of reducing static buildup on garments during a solvent-based dry-cleaning process with a garment bag having a mesh sidewall formed substantially of non-conductive yarns joined together to define a plurality of interstices sized to permit solvent and dirt from garments contained in the garment bag but not the garments themselves to pass into and out of an interior cavity of the garment bag through the mesh sidewall of the garment bag, the garment bag further having an opening sized to permit garments to pass therethrough in the interior cavity of the garment bag, the method comprising:

providing conductive strands in the sidewall of the garment bag to provide an electrical resistance of less than 1 kilo ohm between any two portions of the sidewall including the conductive strands and within twelve inches of each other and thereby render the sidewall conductive and the garment bag anti-static;

placing the garment bag in a dry-cleaning machine along with a load of garments to be dry-cleaned;

and performing the dry-cleaning process, whereby the garment bag reduces static buildup during the dry-cleaning process.

8. The method of claim 1 wherein the conductive strands are interspersed in the sidewall so as to provide a substantially continuous low electrical resistance on inner and outer surfaces of the sidewall.

9. The method of claim 1 wherein the conductive strands are interspersed in the sidewall so as to provide an electrical resistance of less than 1 kilohm between any two portions of the sidewall within 12 inches of each other.

10. The method of claim 1 wherein the conductive strands are interspersed in the sidewall so as to provide an electrical resistance of less than 200 ohms between any two portions of the sidewall within 12 inches of each other.

11. The method of claim 1 the conductive strands being synthetic filaments chemically plated with silver.

12. The method of claim 1 the conductive strands being synthetic filaments chemically plated with silver, to 13% by weight of silver.

13. The method of claim 1 wherein the conductive strands are interspersed in a diamond grid matrix pattern throughout the sidewall.

14. The new method of claim 1 further comprising:

joining together the non-conductive yarns to define a generally oval shape to each of the interstices.

15. The method of claim 1 further comprising:

joining together the non-conductive yarns to define a first size to a first number of the interstices and a second, larger size to a second number of the interstices.

* * * * *